US012139832B2

(12) United States Patent
Mifuji et al.

(10) Patent No.: US 12,139,832 B2
(45) Date of Patent: Nov. 12, 2024

(54) THREAD STANDING DEVICE AND SEWING MACHINE

(71) Applicant: JANOME Corporation, Hachioji (JP)

(72) Inventors: Tomoro Mifuji, Hachioji (JP); Takeshi Oie, Hachioji (JP)

(73) Assignee: JANOME Corporation, Hachioji (JP)

( * ) Notice: Subject to any disclaimer, the term of this patent is extended or adjusted under 35 U.S.C. 154(b) by 154 days.

(21) Appl. No.: 18/065,625

(22) Filed: Dec. 14, 2022

(65) Prior Publication Data

US 2023/0228022 A1 Jul. 20, 2023

(51) Int. Cl.

*D05B 43/00* (2006.01)
*B65H 49/32* (2006.01)
*D05B 65/00* (2006.01)

(52) U.S. Cl.

CPC ..... *D05B 43/00* (2013.01); *B65H 49/32* (2013.01); *D05B 65/003* (2013.01); *B65H 2701/31* (2013.01)

(58) Field of Classification Search

CPC ..... D05B 43/00; D05B 47/00; D05B 47/02; B65H 49/16; B65H 49/32; B65H 57/04; B65H 57/06; B65H 2701/31

See application file for complete search history.

(56) References Cited

U.S. PATENT DOCUMENTS 349,440 A * 9/1886 Looker ..... B65H 49/08 242/153
2,628,042 A * 2/1953 Fitts ..... D04B 3/06 206/391
3,054,277 A * 9/1962 Broschard ..... D04B 3/00 242/157 R
4,407,461 A * 10/1983 Tomisawa ..... D05B 43/00 242/139
5,125,245 A * 6/1992 Kuwabara ..... D04B 3/04 16/225
5,642,678 A * 7/1997 Mizunuma ..... D05B 47/00 112/302
2023/0043017 A1* 2/2023 Matsubara ..... D05B 43/00
2023/0228022 A1* 7/2023 Mifuji ..... D05B 47/00 112/302

FOREIGN PATENT DOCUMENTS

JP 2000-126488 A 5/2000

* cited by examiner

*Primary Examiner* — Danny Worrell
(74) *Attorney, Agent, or Firm* — Yokoi & Co., U.S.A.; Toshiyuki Yokoi

(57) ABSTRACT

Provided with a thread standing device capable holding a thread with excellent workability and a sewing machine provided with the thread standing device. A thread standing device includes: a spool pin around which a thread reel is inserted; a thread hooking base on which a thread wound around the thread reels is hooked; and a thread holding slider which is slidable with respect to the thread hooking base, the thread holding slider being movable between a first position for covering a thread hooking portion of the thread hooking base and a second position for exposing the thread hooking portion, the thread being hooked on the thread hooking portion, wherein the thread hooked on the thread hooking portion is held when the thread holding slider is slid to the first position.

5 Claims, 5 Drawing Sheets

THREAD STANDING DEVICE AND SEWING MACHINE

CROSS-REFERENCE TO RELATED APPLICATIONS

This patent specification is based on Japanese patent application, No. 2022-006992 filed on Jan. 20, 2022 in the Japan Patent Office, the entire contents of which are incorporated by reference herein.

PRIOR ART

[Patent Document 1] Japanese Unexamined Patent Application Publication No. 2000-126488

BACKGROUND OF THE INVENTION

In a lock stitch sewing machine, seams are formed by entangling an upper thread with a lower thread. In general, the upper thread is wound around a thread reel and a spool pin is provided on the sewing machine. The thread reel is installed on the spool pin and the upper thread is supplied to a sewing needle.

Conventionally, a thread standing device having a plurality of spool pins which can be preliminarily installed in the vicinity of the sewing machine or attached to the sewing machine itself is known. In such a thread standing device, the thread reels for replacement are preliminarily installed for performing a multicolor sewing and an embroidery sewing, for example. For example, Patent Document 1 shows a thread standing device having a plurality of spool pins (16) capable of attaching a plurality of thread reels and a spool stand (1). In the spool stand (1), in the vicinity of a plurality of guide portions (21) holding a thread, the same number of thread holding portions (30) as the guide portions (21) are provided. The operation of changing the thread is assisted by holing unused upper threads by the thread holding portions (30).

SUMMARY OF THE INVENTION

The above described thread holding portions (30) hold the thread by sandwiching the thread between an O-ring (32) having an elasticity and a mounting part (31) to which the O-ring (32) is fitted. Namely, in order to hold the thread by the O-ring (32) and the mounting part (31), it is necessary to apply a predetermined tension to the thread and enter the thread between the O-ring (32) and the mounting part (31) in a state that the upper thread is tensed. When an operator grasps an end of the thread and tries to enter the thread between the O-ring (32) and the mounting part (31), the other end of the thread is the thread reel for supplying the thread. Thus, it is impossible to apply the tension to the thread merely by grasping the end of the thread. It is necessary to further grasp the other end of the thread to apply the tension to the thread.

As described above, in order to hold the upper thread by the O-ring (32) and the mounting part (31), it is necessary to grasp the thread by both hands. Thus, there is room for improvement from a viewpoint of workability.

The present invention provides a thread standing device capable of holding a thread with excellent workability and a sewing machine provided with the thread standing device.

The present invention is a thread standing device of a sewing machine including: a spool pin around which a thread reel is inserted; a thread hooking base on which a thread wound around the thread reel is hooked; and a thread holding slider which is slidable with respect to the thread hooking base, the thread holding slider being movable between a first position for covering a thread hooking portion of the thread hooking base and a second position for exposing the thread hooking portion, the thread being hooked on the thread hooking portion, wherein the thread hooked on the thread hooking portion is held when the thread holding slider is slid to the first position.

In the above described thread standing device, it is preferred that the thread holding slider includes an engagement portion which is configured to be engaged with the thread hooking base, and the thread hooking base includes a first engagement portion configured to be engaged with the engagement portion to hold the thread holding slider at the first position and a second engagement portion configured to be engaged with the engagement portion to hold the thread holding slider at the second position.

In the above described thread standing device, it is preferred that the thread hooking portion comprises a plurality of thread hooking portions, the thread holding slider comprises a plurality of thread holding sliders having the same number as the thread hooking portions, and each of the thread holding sliders is individually slidable with respect to the thread hooking base.

In the above described thread standing device, it is preferred that the thread holding slider includes: a knob which functions as a finger hook when the thread holding slider is slid with respect to the thread hooking base; a groove portion provided on the knob; and a cutting blade for cutting the thread inserted in the groove portion.

The present invention also includes a sewing machine having one of the above described thread standing devices.

When the thread standing device of the present invention is used, different from the conventional device, it is not necessary to grasp the thread by both hands for applying the tension to the thread and it is possible to switch between the holding state and the releasing state of the thread by sliding the thread holding slider. Namely, the necessary operation is only to slide the thread holding slider by one hand. Thus, the workability is improved compared to the conventional thread standing device where the operation by both hands is needed.

DETAILED DESCRIPTION OF THE INVENTION

Figure 1:
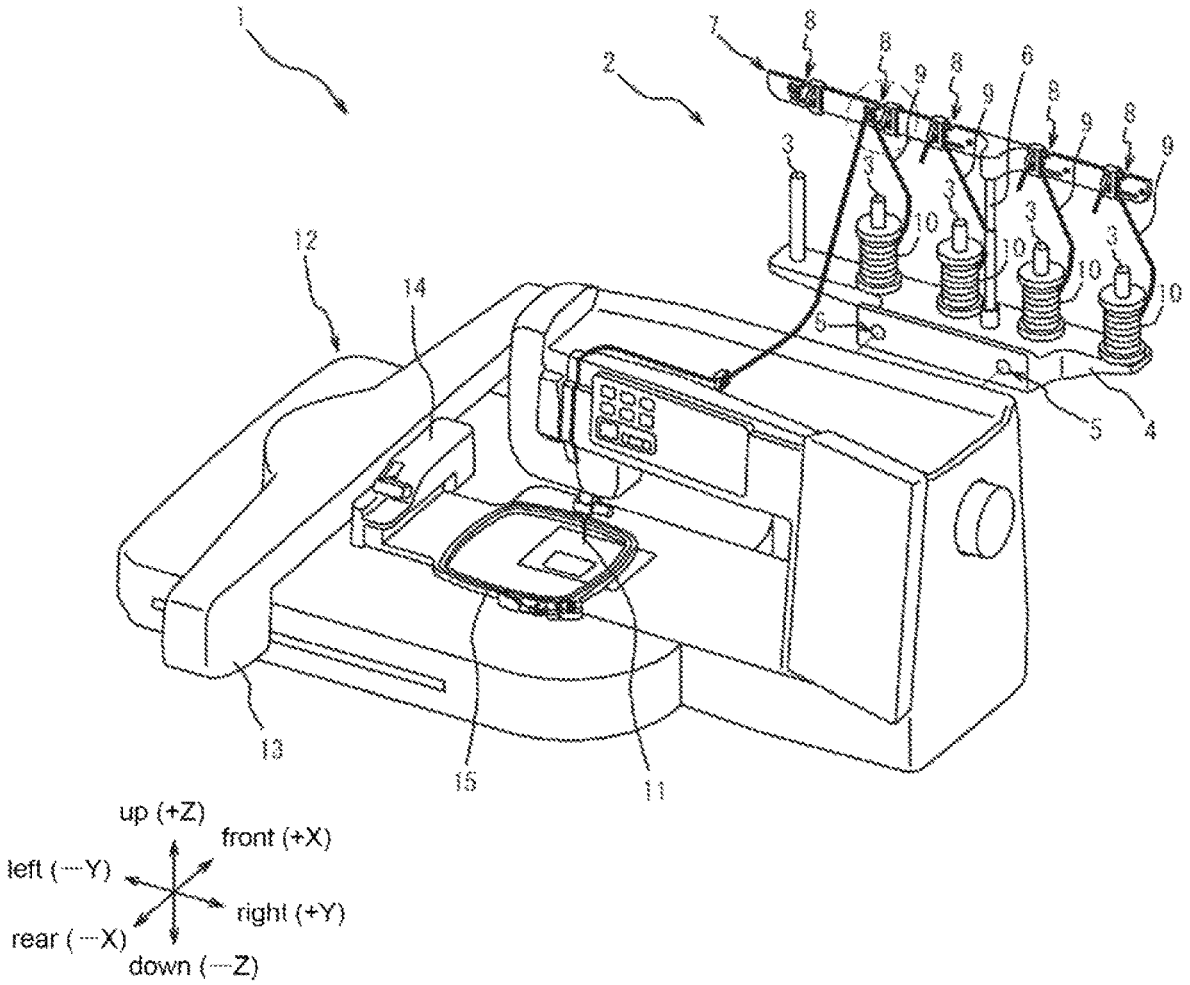
FIG. 1 is a perspective view of a sewing machine having a thread standing device of an embodiment of the present invention.

Hereafter, an embodiment of the thread standing device and an embodiment of the sewing machine having the thread standing device of the present invention will be explained with reference to the drawings. In this specification, the directions of right, left, front, rear, up and down are the directions viewed from a user using a sewing machine 1 in a state that the sewing machine 1 is installed on a working table. In the following explanation, an x-axis direction, a y-axis direction and a Z-axis direction are a front-rear direction, left-right direction and an up-down direction respectively as shown in the drawings.

First, an outline of a sewing machine 1 and a thread standing device 2 of the present embodiment will be explained with reference to FIG. 1. As shown in FIG. 1, the thread standing device 2 of the present embodiment is used in a state that the thread standing device 2 is attached to the sewing machine 1.

The thread standing device 2 includes a thread spool base 4 having a plurality of spool pins 3 formed in a cylindrical shape on an upper surface of the thread spool base 4. Mounting holes 5 are provided on the thread spool base 4 so that the mounting holes 5 penetrate the thread spool base 4 in the front-rear direction. The thread spool base 4 can be fixed to the sewing machine 1 with a not illustrated screw or the like inserted in the mounting holes 5. In addition, a pole 6 extending upward is provided on an upper surface of the thread spool base 4. A thread hooking antenna 7 extending in the left-right direction is provided on an upper end of the pole 6. A plurality of thread holding portions 8 having the same number (five in the present embodiment) as the spool pins 3 is provided on the thread hooking antenna 7.

Threads 9 used as an upper thread in the sewing machine 1 are wound around thread reels 10. Each of the thread reels 10 is inserted around each of the spool pins 3 and the thread 9 drawn out from the thread reel 10 is inserted into a needle hole of a needle 11 via the thread hooking portions 8 through a predetermined portion of the sewing machine 1. Thus, a preparation of the sewing is finished. After that, the sewing machine 1 is driven to form seams by entangling the thread 9 inserted into the needle 11 with a not-illustrated lower thread.

As shown in FIG. 1, the sewing machine 1 of the present embodiment includes an embroidery frame driving device 12. The embroidery frame driving device 12 can move a carriage 14 in the x-axis direction and the Y-axis direction via a YX driving arm 13. An embroidery frame 15 can be attached to the carriage 14. A cloth or the like is fixed to the embroidery frame 15 and a sewing is performed while moving the carriage 14. Thus, an embroidery can be formed on the cloth or the like. A colorful embroidery can be formed on the cloth or the like by preparing a plurality of thread reels 10 around which the threads 9 having a plurality of colors are wound, inserting each of the thread reels 10 around each of the spool pins 3 and performing the sewing while replacing the thread 9.

Figure 2:
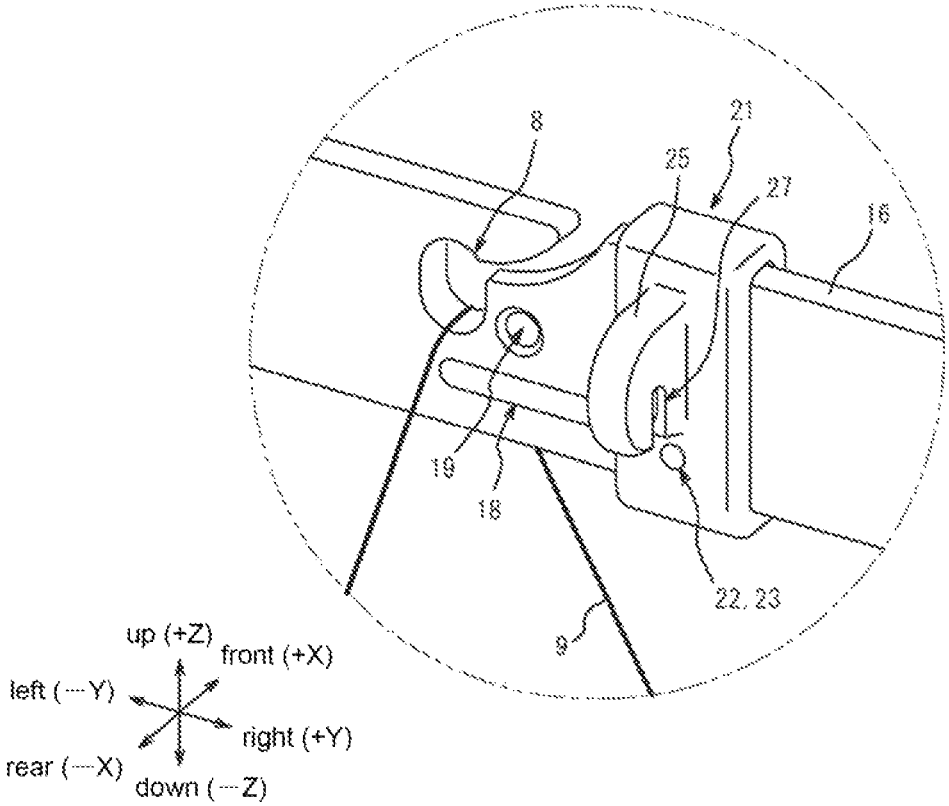
FIG. 2 is a partly enlarged view of a thread hooking portion (two-dot chain line circle) shown in FIG. 1.
Figure 3:
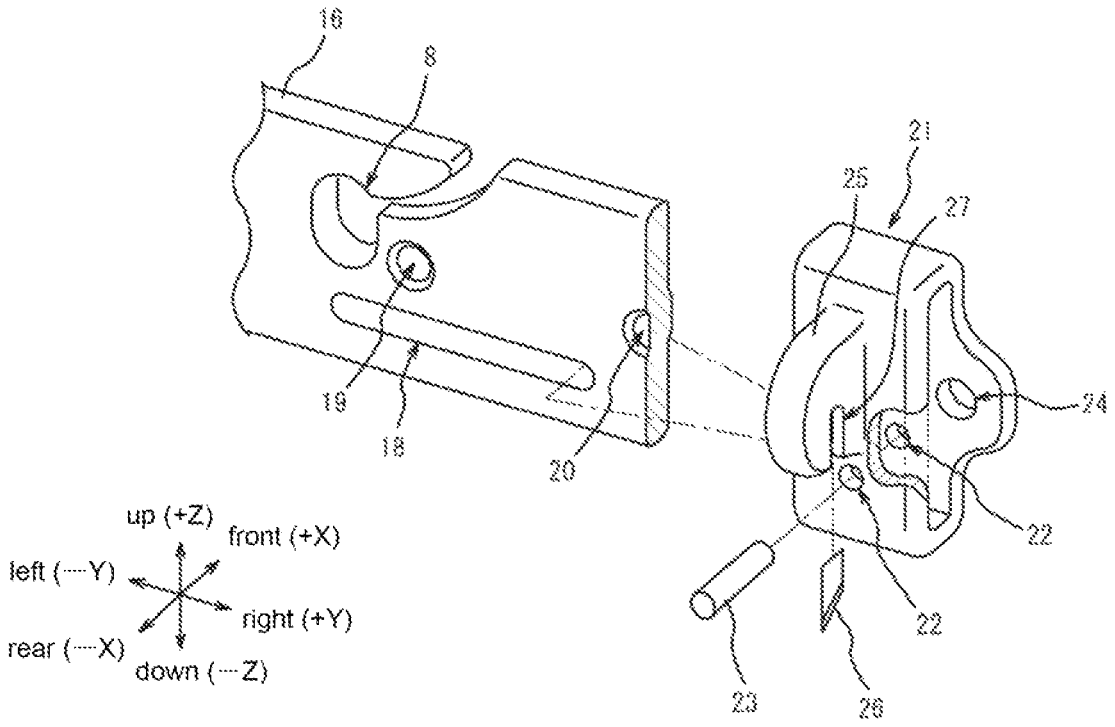
FIG. 3 is an exploded perspective view of the thread hooking portion (two-dot chain line circle) shown in FIG. 1.

Then, a structure of the thread hooking portions 8 and a periphery of the thread hooking portions 8 will be explained in detail. As shown in FIG. 2 and FIG. 3, each of the thread hooking portions 8 of the present embodiment has a shape of combining an elliptical through hole portion penetrating a thread hooking base 16, which is a flat plate shaped portion in the thread hooking antenna 7, in the front-rear direction and a through groove portion which extends from an upper part of the through hole portion to the right upper side obliquely so that the upper end of the thread hooking antenna 7 is notched. Note that the shape of the thread hooking portions 8 is not limited to the shape shown in the drawings. For example, the thread hooking portions 8 can have the shape formed only by the through hole portion or only by the through groove portion. Note that the member is partly cut in FIG. 3 for the convenience of the explanation.

The thread hooking base 16 further includes: a slide groove 18 which penetrates the thread hooking base 16 in the front-rear direction at a lower part of the thread hooking portions 8 and linearly extends in the left-right direction; a first positioning protrusion 19 and a second positioning protrusion 20 which is partly protruded frontward from the front surface of the thread hooking base 16. Same as the thread hooking portions 8, five slide grooves 18, five first positioning protrusions 19 and five second positioning protrusions 20 are provided on the thread hooking base 16.

Figure 5:
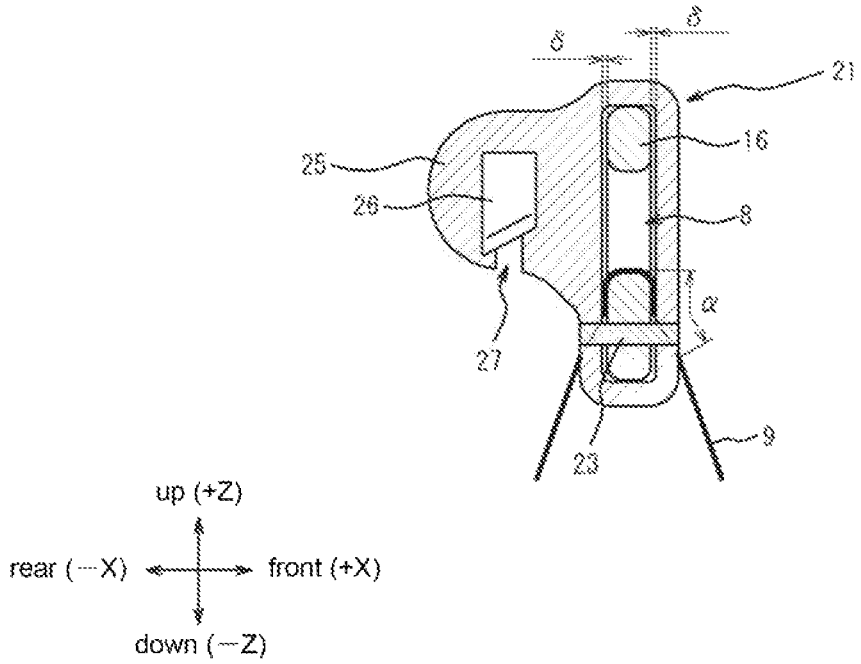
FIG. 5 is a cross-sectional view of the thread hooking portion cut along a line A-A shown in FIG. 4B.

Thread holding sliders 21 are attached to the thread hooking base 16. In the present embodiment, five thread holding sliders 21 are attached to the thread hooking base 16. As shown in FIG. 5, each of the thread holding sliders 21 is formed in a longitudinal rectangular frame shape in the cross-section (FIG. 5), and the thread hooking base 16 is inserted in an inner hole of the thread holding slider 21. In a state that the thread holding slider 21 is inserted in the thread hooking base 16, two clearances having a width 6 are formed between the inner hole of the thread holding slider 21 and the thread hooking base 16 in the front-rear direction as shown in FIG. 5. Here, the width 6 is specified approximately same as the outer diameter of the thread 9.

As shown in FIG. 3, a circular pin hole 22 penetrating the thread holding slider 21 in the front-rear direction is provided on each of the thread holding sliders 21. A cylindrical slide pin 23 is inserted in the pin hole 22. Thus, the slide pin 23 is held by the thread holding slider 21. When the slide pin 23 is inserted in the pin hole 22, the slide pin 23 is also inserted in the slide groove 18. Namely, the thread holding slider 21 can be relatively moved in the left-right direction within a range where the slide pin 23 moves between the left end and the right end of the slide groove 18 while the thread holding slider 21 is restricted from relatively moving in the up-down direction by the slide pin 23 inserted in the slide groove 18. In the present embodiment, the position where the thread holding slider 21 is moved leftward and the slide pin 23 reaches the left end of the slide groove 18 corresponds to "first positon" in this specification, and the position where the thread holding slider 21 is moved rightward and the slide pin 23 reaches the right end of the slide groove 18 corresponds to "second positon" in this specification.

As shown in FIG. 3, a positioning hole 24 is provided on a front side wall of each of the thread holding sliders 21. The positioning hole 24 is engaged with the first positioning protrusion 19 at a position where the thread holding sliders 21 is moved leftward with respect to the thread hooking base 16 and the slide pin 23 reaches the left end of the slide groove 18. Thus, the thread holding sliders 21 is positioned with respect to the thread hooking base 16. Alternatively, the positioning hole 24 is engaged with the second positioning protrusion 20 at a position where the thread holding sliders 21 is moved rightward and the slide pin 23 reaches the right end of the slide groove 18. Thus, the thread holding sliders 21 is positioned with respect to the thread hooking base 16. Here, it is not required to significantly increase an engaging force between the first positioning protrusion 19 or the like and the positioning hole 24. It is enough if the first positioning protrusion 19 or the like can be engaged with or disengaged from the positioning hole 24 only by giving light force to the thread holding slider 21. In the present embodiment, the positioning hole 24 corresponds to "engagement portion" in this specification. Similarly, the first positioning protrusion 19 corresponds to "first engagement portion" and the second positioning protrusion 20 corresponds to "second engagement portion" in this specification.

Furthermore, a knob 25 protruding from the front to the rear is provided on a rear side wall of the thread holding slider 21. A cutting blade 26 having a blade portion at a lower end is provided inside the knob 25. Furthermore, a groove portion 27 formed by notching the knob 25 upward from below is provided on the knob 25 to expose a lower end of the cutting blade 26.

The sewing machine 1 formed by the above described members is used in a state shown in FIG. 1, for example. FIG. 1 shows a state that the thread reels 10 are inserted around four spool pins 3 located at the right side and each of the threads 9 drawn out from each of the thread reels 10 is held by each of the thread holding sliders 21 located above each of the spool pins 3. The configuration of holding the thread 9 by the thread holding slider 21 will be explained in detail later.

The thread 9 of the thread reel 10 inserted around the fourth spool pin 3 from the right in FIG. 1 is inserted in a needle hole of the needle 11 via the thread hooking portion 8 located above this spool pin 3 and via a predetermined portion of the sewing machine 1. Consequently, the preparation of the sewing using the thread 9 is finished. If the shape of the thread hooking portion 8 is formed only by a through hole, it is necessary to insert an end of the thread 9 into the through hole from the front to the rear when preparing the sewing. Thus, there is a problem in workability. On the other hand, the thread hooking portion 8 of the present embodiment has a shape combining the elliptical through hole portion and a through groove portion notching the upper end of the thread hooking base 16. The thread 9 can be inserted in the through groove portion by inserting the thread 9 tensed in the front-rear direction in the through groove portion. Thus, the workability is excellent. As shown in FIG. 2, the elliptical through hole portion is connected with the through groove portion at the upper portion of the elliptical through hole portion. The elliptical through hole portion is positioned higher than the portion where the thread 9 passes through toward the thread reel 10 and the needle 11. Namely, the thread 9 directed from the thread reel 10 to the needle 11 via the thread hooking portion 8 passes thorough the lower side of the elliptical through hole portion in the thread hooking portion 8. Thus, when the sewing is performed by driving the sewing machine 1, the thread 9 is prevented from being unintentionally removed from the through groove portion in the thread hooking portion 8.

Figure 4A:
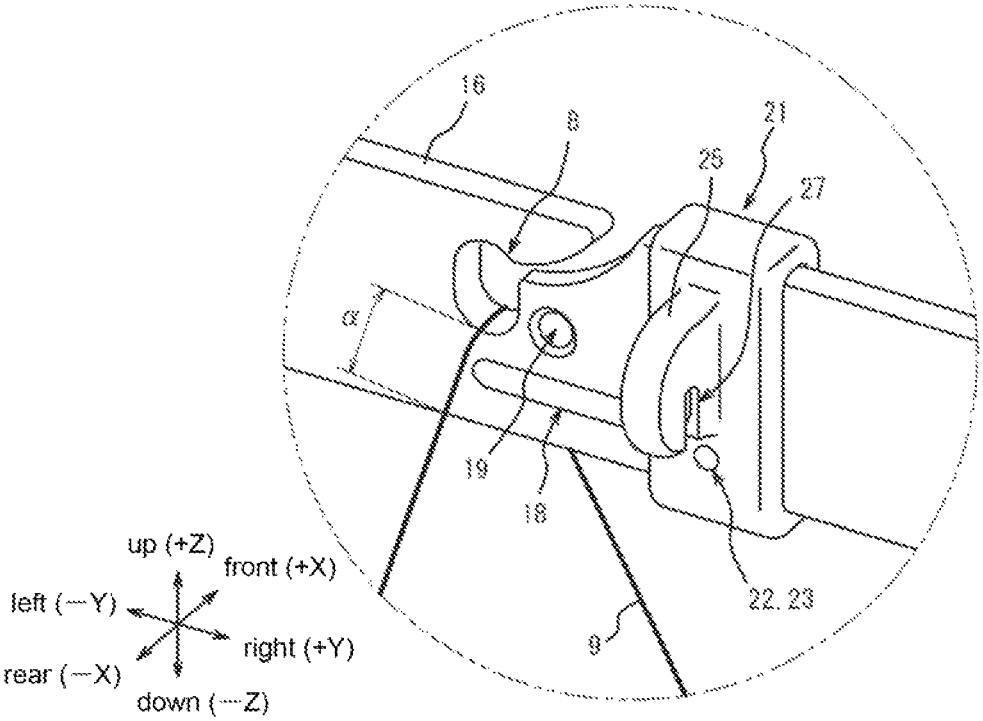
FIG. 4A is a partly enlarged view of the thread hooking portion in a state that the thread holding slider is positioned at the second position and the thread is released.

Here, the fourth thread holding slider 21 from the right in FIG. 1 is moved rightward as shown in FIG. 4A and the positioning hole 24 shown in FIG. 3 is engaged with the second positioning protrusion 20. Namely, the thread holding slider 21 is not unintentionally moved. Thus, the thread holding slider 21 is prevented from being unintentionally removed leftward during the sewing. Consequently, the troubles such as the entanglement of the thread 9 to the thread holding slider 21 can be prevented.

Figure 4B:
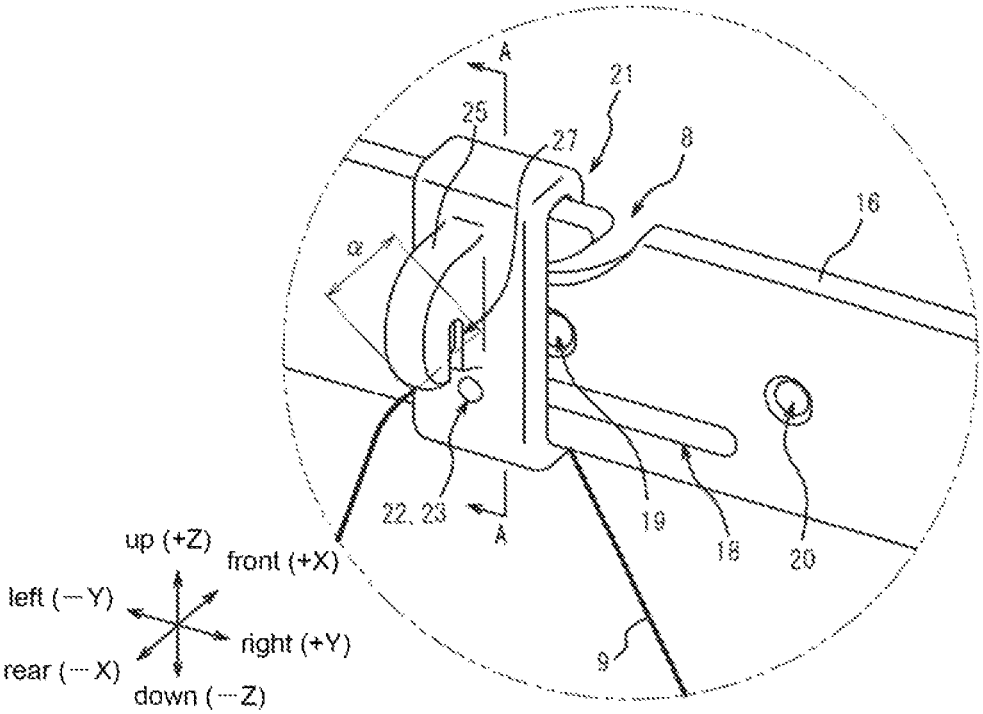
FIG. 4B is a partly enlarged view of the thread hooking portion in a state that the thread holding slider is positioned at the first position and the thread is held.

For replacing the thread 9 inserted in the needle hole of the needle 11 with another thread 9 in FIG. 1, the thread 9 can be pulled out of the needle hole of the needle 11 and the predetermined portion of the sewing machine 1 by pulling the thread 9 at the position nearer to the needle 11 than the thread hooking base 16. Then, the thread holding slider 21 is slid leftward as shown in FIG. 4B. The thread holding sliders 21 of the present embodiment includes the knob 25. Thus, the thread holding sliders 21 can be easily slid by hooking a finger on the knob 25. In addition, in the thread holding slider 21 slid leftward is prevented from being unintentionally moved since the positioning hole 24 is engaged with the first positioning protrusion 19.

However, the thread hooking portion 8 shown in FIG. 4A is covered with the thread holding slider 21 when the thread holding slider 21 is moved leftward (first position) as shown in FIG. 4B. As also described above, two clearances having the width 6 are formed between the inner hole of the thread holding slider 21 and the thread hooking base 16 in the front-rear direction as shown in FIG. 5 and the width 6 is specified approximately same as the outer diameter of the thread 9. Namely, when the thread holding slider 21 is moved leftward, the thread holding slider 21 is in contact with the thread 9 near the thread hooking portion 8. Namely, minute frictional force acts between an a portion of the thread 9 and the thread hooking base 16 or the thread holding slider 21. Thus, the thread 9 can be held while the movement of the thread 9 is restricted.

An excessive portion of the thread 9 held by the thread holding slider 21 and extended toward the needle 11 is guided to the inside of the groove portion 27. Thus, the excessive portion of the thread 9 can be cut by the cutting blade 26. Namely, it is not required to prepare scissors or other tools independently for cutting the excessive portion of the thread 9.

The thread holding slider 21 holding the thread 9 to be replaced (used) is moved rightward to release the thread 9 and the thread 9 is inserted in the needle hole of the needle 11 via the predetermined portion of the sewing machine 1. Thus, the sewing can be performed using the replaced thread 9.

As described above, in the sewing machine 1 of the present embodiment, the thread 9 can be held only by sliding the thread holding slider 21 leftward and the operation of sliding the thread holding slider 21 can be performed by one hand. Namely, different from the sewing machine of the above described Patent Document 1, it is not required to hold the thread by both hands. Thus, the workability is excellent. Meanwhile, in the conventional sewing machine shown in Patent Document 1, the thread is held by sandwiching the thread between the O-ring (32) and the mounting part (31). However, this portion has similar configuration as a part of a thread path of a general sewing machine. Accordingly, in addition to the ordinary usage where the not used thread is held by the O-ring (32) and the mounting part (31), there is a risk that the thread for performing the sewing is set while being inserted between the O-ring (32) and the mounting part (31). If the thread is set in the above described wrong state, the malfunction may occur such that an excess load is applied to the thread to cut the thread during the sewing or the O-ring (32) is worn by the moving thread. On the other hand, the thread holding slider 21 of the present embodiment is hardly mistaken for a thread path. Thus, the above described malfunction hardly occurs. In addition, in the thread holding slider 21 of the present embodiment, the engagement between the first positioning protrusion 19 and the positioning hole 24 is released when a light force is applied. Even when the sewing is performed by mistake in a state that the thread 9 is held by the thread holding slider 21, the engagement between the first positioning protrusion 19 and the positioning hole 24 is released by the tension transmitted from the thread 9. Thus, an excess load is not applied to the thread 9 from the thread holding slider 21.

Although the embodiment realizing the present invention is exemplified above, the present invention is not limited to a specific embodiment. Unless particularly limited in the above described explanation, various modification and change are possible in the range of the scope of the present invention described in the claims. In addition, the above described effects of the embodiments merely exemplify the effects arisen from the present invention. The effects of the present invention are not limited to the above described effects.

For example, in the above described embodiment, the first positioning protrusion 19 and the second positioning protrusion 20 which are partly protruded from the thread hooking base 16 are provided and the positioning hole 24, which is a through hole, is provided on the thread holding slider 21. However, it is also possible to mutually exchange them so that the through hole is provided on the thread hooking base 16 and the protrusions are provided on the thread holding slider 21.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

The invention claimed is:

1. A thread standing device of a sewing machine, comprising:

a spool pin around which a thread reel is inserted;

a thread hooking base on which a thread wound around the thread reel is hooked; and a thread holding slider which is slidable along a longitudinal direction of the thread hooking base, the thread holding slider being movable between a first position for covering a thread hooking portion of the thread hooking base and a second position for exposing the thread hooking portion, the thread being hooked on the thread hooking portion, wherein the thread hooked on the thread hooking portion is held when the thread holding slider is slid to the first position.

2. The thread standing device according to claim 1, wherein the thread holding slider includes an engagement portion which is configured to be engaged with the thread hooking base, and the thread hooking base includes a first engagement portion configured to be engaged with the engagement portion to hold the thread holding slider at the first position and a second engagement portion configured to be engaged with the engagement portion to hold the thread holding slider at the second position.

3. The thread standing device according to claim 1, wherein the thread hooking portion comprises a plurality of thread hooking portions, the thread holding slider comprises a plurality of thread holding sliders having the same number as the thread hooking portions, and each of the thread holding sliders is individually slidable with respect to the thread hooking base.

4. The thread standing device according to claim 1, wherein the thread holding slider includes: a knob which functions as a finger hook when the thread holding slider is slid with respect to the thread hooking base; a groove portion provided on the knob; and a cutting blade for cutting the thread inserted in the groove portion.

5. A sewing machine, comprising:

the thread standing device according to claim 1.

* * * * *